US007856926B2

(12) United States Patent
Thal

(10) Patent No.: US 7,856,926 B2
(45) Date of Patent: Dec. 28, 2010

(54) PRINTING METHOD FOR PRODUCING MATTE AND GLOSSY PRINTED SURFACES

(75) Inventor: Rolf Thal, Schwanewede (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 867 days.

(21) Appl. No.: 11/452,633

(22) Filed: Jun. 14, 2006

(65) Prior Publication Data

US 2006/0230965 A1 Oct. 19, 2006

Related U.S. Application Data

(63) Continuation of application No. PCT/EP2004/014534, filed on Dec. 21, 2004.

(30) Foreign Application Priority Data

Dec. 22, 2003 (DE) ..... 103 60 050

(51) Int. Cl.
*B41M 3/00* (2006.01)

(52) U.S. Cl. ..... 101/483

(58) Field of Classification Search ..... None
See application file for complete search history.

(56) References Cited

U.S. PATENT DOCUMENTS 4,841,903 A * 6/1989 Bird ..... 101/217
5,794,532 A * 8/1998 Gassies et al. ..... 101/493
5,845,575 A * 12/1998 Eda et al. ..... 101/483
6,637,338 B2 * 10/2003 Veil ..... 101/491
2005/0034619 A1 * 2/2005 Hecht ..... 101/416.1

FOREIGN PATENT DOCUMENTS

DE 200 20 798 U1 4/2001
DE 199 52 204 A1 5/2001
EP 0 620 115 A1 10/1994
EP 1 237 728 B1 2/2002

* cited by examiner

*Primary Examiner*—Jill E Culler
(74) *Attorney, Agent, or Firm*—Laurence A. Greenberg; Werber H. Stemer; Ralph E. Locher

(57) ABSTRACT

A printing method, using a printing press having a plurality of printing units and a downstream varnishing unit, includes initially printing a surface of printing material with an oil-based printing ink in at least one of the printing units in a single run through the printing press. The printing material is subsequently either coated with an oil-based matte varnish containing matting means or printed with a matte ink containing matting means, in a downstream printing unit, on part of the surface having been printed with printing ink, and with at least one material having a low surface energy being admixed to the matte varnish or the matte ink. The printing material is then coated with a transparent glossy varnish on the entire printed surface in the varnishing unit. A printed product is also provided.

42 Claims, 1 Drawing Sheet

PRINTING METHOD FOR PRODUCING MATTE AND GLOSSY PRINTED SURFACES

CROSS-REFERENCE TO RELATED APPLICATIONS

This is a continuation, under 35 U.S.C. §120, of copending International Application No. PCT/EP2004/014534, filed Dec. 21, 2004, which designated the United States; this application also claims the priority, under 35 U.S.C. §119, of German Patent Application DE 103 60 050.7, filed Dec. 22, 2003; the prior applications are herewith incorporated by reference in their entirety.

BACKGROUND OF THE INVENTION

Field of the Invention

The invention relates to a printing method, in particular a sheet-fed offset printing method, wherein, after being printed, a printing material is provided with a matte surface on a part of the printed surface and with a glossy surface on another part of the printed surface, through the use of spot varnishing with transparent varnishes or by overprinting with an ink that contains matting means. Due to the different surface qualities and the contrast between adjacent matte and glossy surface parts, for example, the contrast between different colors of the printed image can be enhanced, the matte-varnished surface parts may be given a velvety appearance and the glossy-varnished surface parts may be given a reflecting, silvery, or golden appearance, or other appealing optical effects may be achieved.

The invention further relates to a printed product produced in accordance with an offset printing method.

It has become known to feed the printing material twice in immediate succession through an offset printing press in order to produce printed products with adjacent matte and glossy surface parts. In the process, i.e. in the first run, the printing material is printed with the desired printing inks in the printing units of the printing press, and then either the areas to be glossy are coated with a glossy varnish or the areas to be matte are coated with a matte varnish in a downstream varnishing unit of the printing press. The respective other areas remain uncoated and are not varnished until the second run through the press. That method, wherein the second application of varnish takes place when the printing ink has already dried, has three important disadvantages.

Firstly, two runs through the press are required, which makes the products more expensive. Secondly, there may be registration errors between the two runs, which may cause visible overlapping areas or gaps between the two different types of surfaces at the borders between the matte and glossy surface parts in the printed image. Thirdly, expensive photopolymer plates are required both for matte and glossy varnishing because conventional offset printing plates cannot be used to coat individual surface parts of the printing material separately.

German Utility Model DE 200 20 798 U1, corresponding to U.S. Patent Application Publication No. US 2002/124744 A1, discloses a device for generating spots of varnish on printing material in a large-format printing press. That device is used to coat the printing material in two of four printing units of the printing press with what is referred to as a hybrid or UV ink system, a way to influence the value of glossiness of the ink layers in a diverging manner. That device provides the possibility of producing printed products, the surfaces of which have sharply contrasting matte and glossy surfaces.

However, that requires a UV exposure unit downstream of a part of the printing units, which requires expensive retrofits for conventional offset printing units or may even be impossible to implement. Moreover, hybrid or UV ink systems are more expensive than the typical oil-based offset printing ink systems and are more toxic.

In addition, European Patent Application 0 620 115 A1, corresponding to U.S. Pat. No. 5,638,752, discloses a device for inline coating of printing material in offset printing presses which provides the possibility of providing spots of varnish of a printing material in one run. For that purpose, however, the known device requires two varnishing units downstream of the offset printing units. The first unit, which is adjacent the offset printing units, is a flexographic printing unit and allows the application of quickly evaporating water-based liquids. The second unit, which is located downstream of the first varnishing unit, is used, for example, to varnish the entire surface of the printing material. However, the known device is unable to produce printed products that have highly contrasting very matte and very glossy varnished surfaces. Moreover, offset printing presses equipped with the known device are very expensive and therefore not widely used.

European Patent EP 1 237 728 B1, corresponding to Australian Patent Application 1285501 A and Canadian Patent Application 2389322 A1, discloses a method for decorating cylindrical bodies. Matte and glossy subjects are generated simultaneously by applying an ink that contains matting means, such as white carbon, before the entire surface is subsequently varnished with a glossy varnish. Apart from the fact that the document deals with a special printing device for varnishing cylindrical bodies, the method can only be used to create a limited contrast, i.e. a limited difference between the values of glossiness, between the matte and glossy image areas.

SUMMARY OF THE INVENTION

It is accordingly an object of the invention to provide a printing method, in particular, but not exclusively, a sheet-fed offset printing method, for producing matte and glossy surfaces, and a printed product, which overcome the hereinaforementioned disadvantages of the heretofore-known methods and products of this general type, in which the printing method is improved in such a way that a printing material with adjacent matte and glossy surfaces is created in a single run in conventional printing presses and in which a printed product is produced with highly contrasting adjacent matte and glossy surfaces by using only conventional offset printing presses and conventional oil-based offset printing inks.

With the foregoing and other objects in view there is provided, in accordance with the invention, a printing method. The method comprises providing a printing press having a plurality of printing units and a downstream varnishing unit. Initially, a surface of printing material is printed with an oil-based printing ink in at least one of the printing units in a single run through the printing press. Subsequently, either the printing material is coated with an oil-based matte varnish containing matting means or the printing material is printed with a matte ink containing matting means, in a downstream printing unit, on part of the surface having been printed with printing ink. At least one material having a low surface energy, such as silicone, PTFE, or a derivative, is admixed to the matte varnish or the matte ink. Then, the printing material is coated with a transparent glossy varnish on the entire printed surface in the varnishing unit.

The printing method according to the invention, which includes offset printing methods and flexographic printing methods in the context of the invention, can easily be implemented in conventional printing presses because the coating of surface parts with, for example, the oil-based matte varnish or the matte ink, can be performed in one of the offset printing units without requiring any retrofitting or modifications. The subsequent coating of the entire surface with the water-based glossy varnish can be performed in a conventional varnishing unit for offset printing presses that has undergone some minor changes which are easily implemented to improve the value of glossiness of the surface parts that are to become glossy.

The invention is based on the concept that the matte and glossy surface parts of the printed product are generated not by using two different ink systems, as suggested by German Utility Model DE 200 20 798 U1, corresponding to U.S. Patent Application Publication No. US 2002/124744 A1, but by a single ink system including oil-based inks or varnishes. It has been found that due to the material with low surface energy contained in the matte layer of ink or varnish, the layer of ink or varnish modified by its content of particle-shaped matting means maintains its matte appearance despite the subsequent application of a glossy varnish to the entire surface.

This happens because, among other reasons, the glossy varnish applied onto the matte varnish or the matte ink is prevented from thoroughly wetting the matte varnish or matte ink due to the admixed material with low surface energy. The material with a low surface energy of preferably less than 40 Millinewtons per meter (mN/m) and especially less than 25 mN/m may, for example, be silicone oil, PTFE (polytetrafluorethylene) known as "TEFLON", or derivatives of these materials such as hexafluorpropylene, fluorinated ethylene-propylene copolymer (FEP), Hostaflon, etc.

In accordance with another mode of the invention, the matte ink or varnish and the glossy varnish are respectively applied before complete hardening or absorption of the previously applied glossy printing ink and, in the latter case, the matte varnish as well. Thus, the printing inks and matte varnish to be used can be conventional oil-based offset printing inks and a conventional oil-based matte varnish, which can respectively be applied to the printing material without additional measures such as UV lamps, in offset printing units of conventional offset printing presses.

In accordance with a further mode of the invention, the glossy varnish to be used is preferably a water-based dispersion varnish because water-based dispersion varnishes can, on one hand, be easily processed in the varnishing units of conventional offset printing presses and, on the other hand, provide the desired matte surface in connection with the matte ink or varnish while providing a glossy surface on the surface parts that are not coated with the matte varnish. The dispersion varnish that is used is preferably based on a styrene acrylate copolymer. However, other types of dispersion varnish based on different polymers can be used as well.

In accordance with an added mode of the invention, in order to provide the sharpest possible contrast between the matte surface parts and the glossy surface parts, the matte surface parts have a value of glossiness that is as low as possible and the glossy surfaces have a value of glossiness that is as high as possible.

In accordance with an additional mode of the invention, the lowest possible value of glossiness of the matte surface parts is aided by setting the content of matting means to be as high as possible without affecting the processing qualities and the transparency of the matte varnish. The preferred matting means are finely grated silicates. However, other types of conventional matting means can be used. Due to the high content of particle-shaped matting means, the matte varnish has a rough surface that can almost completely reabsorb at least smaller amounts of the glossy varnish.

In accordance with yet another mode of the invention, a similar effect is attained when the matte varnish or the matte ink only wets the previously applied printing ink to an incomplete degree, which also causes the surface to become structured. This purpose is also aided by the silicone oil or PTFE that is added to the matte varnish or matte ink, preferably in a range of from 0.2 to 0.6 percent by weight. The incomplete wetting of the offset printing ink base resulting from the silicone oil, for example, together with the matting means, causes the matte varnish to acquire a uniform, hammer tone finish, scaly surface after its application.

In order to achieve the highest possible value of glossiness of the glossy surface parts as the glossy varnish is applied without considerably increasing the value of glossiness of the matte surface parts, further preferred embodiments of the invention include several measures that may be implemented individually or, preferably, in combination.

In accordance with yet a further mode of the invention, a first measure is to apply an amount of glossy varnish that is sufficient on one hand to create a continuous glossy surface on the surface parts that are not coated to be matte, but, on the other hand, is not large enough to cause the surface parts that have previously been coated to be matte to be completely flooded and the rough surface to be smoothed out. Tests in this respect have found that both objectives can be achieved if the applied amount is between 12 and 14 $cm^3$ of glossy varnish per $m^2$ of application surface. Thus, the glossy varnish is preferably metered in the varnishing unit by a chambered doctor blade and a screen roller that has a take up volume of about 13 $cm^3/m^2$.

In accordance with yet an added mode of the invention, a second measure is to use a glossy varnish that has a high viscosity. This also counteracts a smoothing out of the rough surface. A suitable viscosity of the glossy varnish is higher than 70 $S^{-1}$, preferably higher than 75 $S^{-1}$ and ideally higher than 80 $S^{-1}$, as measured in accordance with DIN (German Standards Institution) 53 211. The high viscosity of the glossy varnish is preferably attained in that the glossy varnish has a high content of resin, e.g. in the form of a styrene acrylate copolymer. A suitable resin content is higher than 20 percent by weight, preferably higher than 25 percent by weight, and ideally higher than 30 percent by weight.

In accordance with yet an additional mode of the invention, since the aforementioned high viscosities of the glossy varnish may cause processing difficulties, glossy varnish is applied at an elevated temperature to the printing material that has been printed and partially coated to be matte. That is to say that the glossy varnish preferably has a temperature of more than 20° C., preferably more than 25° C. and ideally more than 30° C. For this purpose, the glossy varnish is expediently heated up to a temperature of more than 30° C. and preferably of more than 40° C. in a heatable container and is then pumped into the chambered doctor blade as required. In order to prevent the glossy varnish from adhering to the walls of the container, the latter is preferably equipped with a stirring unit including stripper blades.

In accordance with still another mode of the invention, a third measure is to reduce the concentration of a wetting agent that is normally present in water-dispersing glossy varnishes as much as possible, expediently to less than 3 percent by weight, preferably less than 2.5 percent by weight and ideally less than 2 percent by weight. These values relate to a sulfosuccinate as an example for a wetting agent. In order to prevent cracks from forming in the glossy varnish during the subsequent drying of the glossy varnish that has been applied to the damp printing ink and the damp matte varnish, an effect which is referred to as the Rembrandt effect and results from such a low content of wetting agent, the glossy varnish preferably contains a softening agent ranging between 0.2 and 1.5 percent by weight of the glossy varnish and preferably between 0.5 and 1 percent by weight.

In accordance with still a further mode of the invention, in order to provide a quick, smear-free deposit of the sheets exiting the varnishing unit in sheet-fed offset printing or a quick, smear-free winding up of the printed and varnished printing material in web-fed offset printing, warm air and/or thermal radiation is applied at least to the printed and varnished side of the printed material after the latter has been coated with the glossy varnish, so that the glossy varnish and the printing ink dry more quickly.

With the objects of the invention in view, there is concomitantly provided a printed product. The printed product comprises a printing material having at least one side with a surface. An oil-based offset printing ink is printed on the surface. An oil-based matte varnish is coated on or a matte ink is printed on a part of the printed surface. The matte varnish or matte ink contains matting means. At least one material having a low surface energy is admixed to the matte varnish or the matte ink. A transparent water-based glossy varnish is coated on the entire printed surface including the part of the surface coated with the matte varnish or printed with the matte ink.

Therefore, with respect to the printed product, the aforementioned object is attained in accordance with the invention in that a printing material of the printed product, preferably art paper, is printed on at least one side with an oil-based offset printing ink, is coated on part of the surface with an oil-based matte varnish or matte ink containing matting means, and is coated on the entire printed surface, including the surface part that has been coated to be matte, with a transparent water-based glossy varnish, with the matte varnish or the matte ink containing silicone or TEFLON or a material with similar hydrophobic or separating properties.

Other features which are considered as characteristic for the invention are set forth in the appended claims.

Although the invention is illustrated and described herein as embodied in a printing method for producing matte and glossy surfaces and a printed product, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The FIGURE of the drawing is a fragmentary, diagrammatic, side-elevational view of a sheet-fed offset printing press for applying spots of varnish, the printing press including a plurality of offset printing units and a downstream varnishing unit.

DESCRIPTION OF THE PREFERRED EMBODIMENTS

Figure 1:
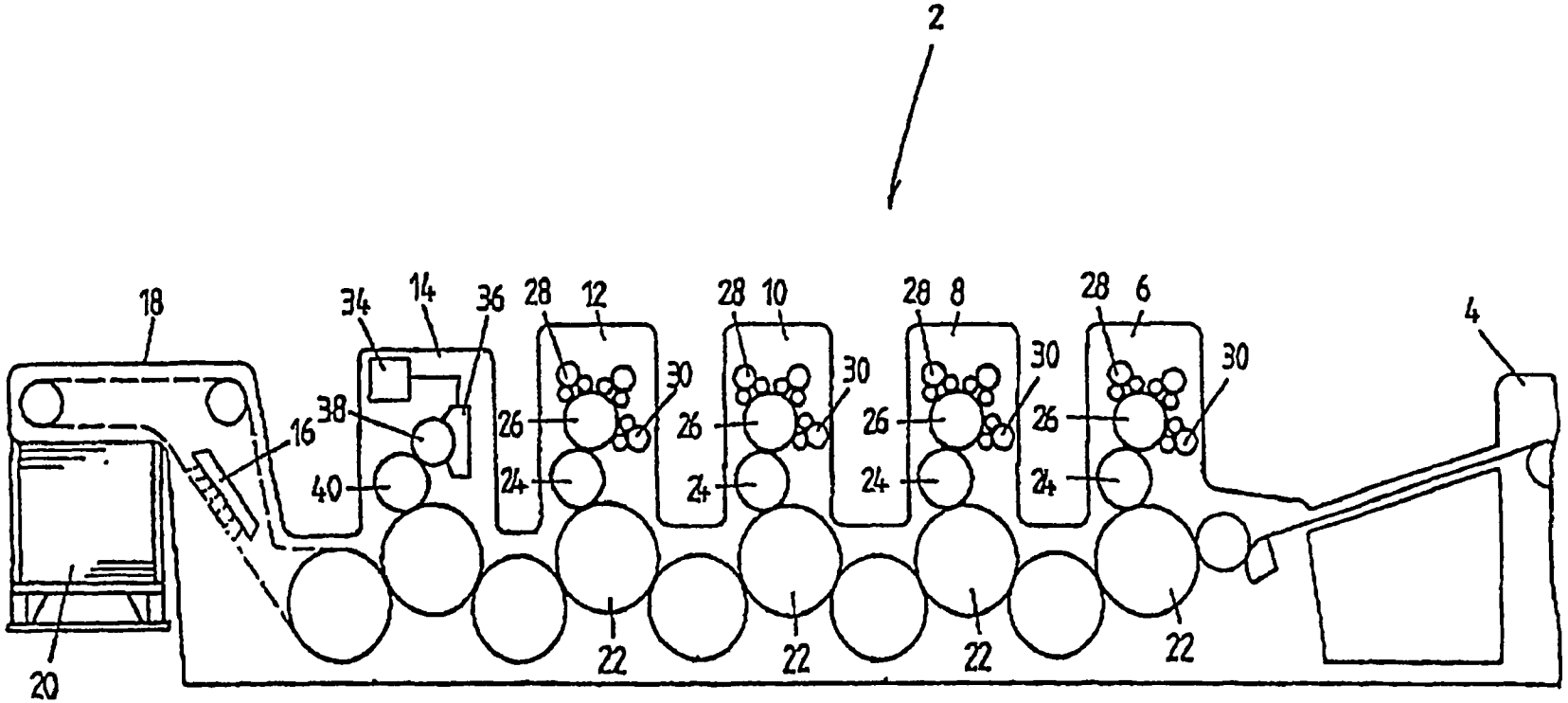

Referring now in detail to the single FIGURE of the drawing, there is seen a conventional four-color, sheet-fed, offset printing press 2 which is substantially formed of a partially-illustrated sheet feeder 4, a total of four offset printing units 6, 8, 10, 12, a varnishing unit 14 disposed downstream of the printing units 6, 8, 10, 12, a drying device 16, and a sheet delivery 18. In the printing press 2, spots of varnish are applied to printing material sheets, in particular art paper sheets, after the sheets have been printed, so that different printing colors are highlighted due to a matte or glossy surface of different parts of the printed image, contrasts are enhanced, or the printing colors are given a velvety or glossy appearance.

During the printing and spot-varnishing operations, the sheets are printed in the first, second, and third printing units 6, 8, and 10 with conventional oil-based offset printing inks in a single color or in multiple colors and are subsequently coated with an oil-based matte varnish on part of the printed surface in the last printing unit 12. The sheets are coated with a water-based glossy varnish on the entire printed surface in the downstream varnishing unit 14, and are dried in the drying device 16 before they are deposited as finished printed products on a sheet pile 20 by the sheet delivery 18.

The coating of surface parts of the printing material with the matte varnish is done in the last printing unit 12 of the printing press 2. For this purpose, the printing unit 12 is typically equipped with an impression cylinder 22, a blanket cylinder 24, a plate cylinder 26, an inking unit 28, and a dampening unit 30. The inking unit 28 is used to meter the matte varnish, which is then applied to the plate cylinder 26, i.e. a plate fastened to the latter, to the blanket cylinder 24, and finally to the sheet guided by the impression cylinder 22, together with the dampening solution. During the process, the matte varnish is applied to those areas of the plate cylinder 26 and of the sheet that correspond to the matte surface parts of the finished printed product, whereas the dampening solution is applied to the remaining areas, i.e. to those areas that correspond to the glossy surface parts of the finished printed product. The matte varnish is applied to the offset printing inks while the latter are still damp, i.e. before the printing inks have dried completely as a result of absorption and cross-linking.

The matte varnish that is used has a similar composition to conventional oil-based offset printing inks but does not contain any color pigments. Instead, it has a high content of matting means in the form of finely grated silicates and between 0.2 and 0.6 percent by weight of silicone oil or another silicone compound, which prevents the offset printing inks that have been applied before the matte varnish from becoming completely wetted or from becoming wetted in a totally uniform way. The matte varnish that is used preferably has a very high value of glossiness. Such a matte varnish is sold by Aquaprint GmbH in Hoyen, Germany under the name Hi Dual 0 700 Matteffect Litho Varnish.

The printed sheets that have been partially coated with the matte varnish will then be completely coated with the water-based glossy varnish in the varnishing unit 14. The glossy varnish is a modified transparent dispersion varnish based on a styrene acrylate copolymer.

In order to prevent those surface parts that have been coated with the matte varnish, and consequently have a rough surface compared to the other surface parts, from becoming "flooded" with the glossy varnish and thus become smoothed out, the percentage of the styrene acrylate copolymer in the dispersion varnish is set to a value of more than 25 percent by weight to increase the viscosity of the dispersion varnish (measured in accordance with DIN 53 211) to more than 75 $S^{-1}$. In order to avoid processing difficulties with a varnish of such a high viscosity, the varnishing unit 14 has a heatable varnish container 34 in which the varnish is kept at a temperature of about 40° C. and moved constantly through the use of a non-illustrated stirring device with stripper blades. Thus the varnish is prevented from adhering to the walls of the container 34.

In addition, the sulfosuccinate content of the glossy varnish is set to be less than 3 percent by weight, ideally to a value between 2 and 2.5 percent by weight. Sulfosuccinate is a typical wetting agent contained in transparent dispersion varnishes commonly used in offset printing. Since such a sulfosuccinate content may cause cracks to appear in the printed product as the latter is dried (Rembrandt effect), between 0.1 and 1 percent by weight of a softening agent is added to the glossy varnish.

Moreover, the varnishing unit 14 applies a precisely defined, limited amount of glossy varnish, i.e. an amount which, on one hand, results in a sufficiently glossy surface on those surface parts that have not been coated with the matte varnish and, on the other hand, causes the glossy varnish to be almost completely reabsorbed by those surface parts that have been coated with the matte varnish without a considerable increase in the value of glossiness of those areas. After several tests, it was found that this is the case if the amount of glossy varnish is selected to be 13 $cm^3/m^2$ of coated printed material surface. In order to meter the glossy varnish, the varnishing unit 14 is equipped with a chambered doctor blade 36 and a screen roller 38, the take-up value of which is approximately the value indicated above, i.e. 13 $cm^3/m^2$. A form or blanket cylinder 40 is used to transfer the glossy varnish from the screen roller 38 to the sheets.

After having been coated with the glossy varnish, the finished printed product is dried at least on the printed and varnished side in the drying device 16 through the use of infrared lamps and/or the application of heated air before the printed product is deposited on the pile 20.

Implementation of the printing conditions described above permits a printing material in the form of art paper to be processed in a single printing and varnishing run through the printing press 2 to create a printed product that has printed surface parts with a matte surface and printed surface parts with a glossy surface adjacent each other. The former has a value of glossiness of about 20% and the latter has a value of glossiness of about 80% (measured at an angle of light incidence and an angle of light reflection of 60 degrees). Therefore, the difference is about 60%, a value that has been impossible to reach thus far with conventional printing presses.

I claim:

1. A printing method, which comprises the following steps:

providing a printing press having a plurality of printing units and a downstream varnishing unit;

initially printing a surface of printing material with an oil-based printing ink in at least one of the printing units in a single run through the printing press;

subsequently either coating the printing material with an oil-based matte varnish containing matting means or printing the printing material with a matte ink containing matting means, in a downstream printing unit, on part of the surface having been printed with printing ink, and with at least one material having a low surface energy being admixed to the matte varnish or the matte ink; and then coating the printing material with a transparent glossy varnish on the entire printed surface in the varnishing unit; and preventing the glossy varnish from thoroughly wetting the matte varnish or matte ink due to the admixed material with low surface energy to permit the matte varnish or matte ink to maintain its appearance.

2. The method according to claim 1, which further comprises applying the matte varnish or matte ink before the printing ink has hardened.

3. The method according to claim 2, which further comprises applying the glossy varnish before the printing ink and the matte varnish or matte ink have hardened.

4. The method according to claim 1, wherein the matte varnish or matte ink contains a high proportion of matting means.

5. The method according to claim 3, wherein the glossy varnish is a water-based glossy varnish.

6. The method according to claim 5, wherein the glossy varnish is a dispersion varnish.

7. The method according to claim 3, wherein the glossy varnish has a viscosity of more than 70 $s^{-1}$ measured in accordance with DIN 53 211.

8. The method according to claim 7, wherein the glossy varnish has a viscosity of more than 75 $s^{-1}$ measured in accordance with DIN 53 211.

9. The method according to claim 8, wherein the glossy varnish has a viscosity of more than 80 $s^{-1}$ measured in accordance with DIN 53 211.

10. The method according to claim 3, which further comprises carrying out the step of coating with the glossy varnish by applying the glossy varnish in a heated condition to the part of the surface of the printed printing material having been coated with the matte varnish.

11. The method according to claim 3, which further comprises carrying out the step of coating with the glossy varnish by applying the glossy varnish at a temperature of more than 20° C. to the part of the surface of the printed printing material having been coated with the matte varnish.

12. The method according to claim 11, which further comprises carrying out the step of coating with the glossy varnish by applying the glossy varnish at a temperature of more than 25° C. to the part of the surface of the printed printing material having been coated with the matte varnish.

13. The method according to claim 12, which further comprises carrying out the step of coating with the glossy varnish by applying the glossy varnish at a temperature of more than 30° C. to the part of the surface of the printed printing material having been coated with the matte varnish.

14. The method according to claim 13, which further comprises keeping the glossy varnish in a container maintaining the glossy varnish at a temperature of more than 30° C. and keeping the glossy varnish in motion, before carrying out the step of coating with the glossy varnish.

15. The method according to claim 14, which further comprises keeping the glossy varnish in a container maintaining the glossy varnish at a temperature of more than 40° C. and keeping the glossy varnish in motion, before carrying out the step of coating with the glossy varnish.

16. The method according to claim 1, wherein the glossy varnish contains less than 3 percent by weight of wetting means.

17. The method according to claim 16, wherein the glossy varnish contains less than 2.5 percent by weight of wetting means.

18. The method according to claim 17, wherein the glossy varnish contains less than 2 percent by weight of wetting means.

19. The method according to claim 1, wherein the glossy varnish contains a softening agent.

20. The method according to claim 19, wherein a proportion of the softening agent in the glossy varnish ranges between 0.2 and 1.5 percent by weight.

21. The method according to claim 19, wherein a proportion of the softening agent in the glossy varnish ranges between 0.5 and 1 percent by weight.

22. The method according to claim 6, wherein the glossy varnish has a resin content of more than 20 percent by weight.

23. The method according to claim 22, wherein the glossy varnish has a resin content of more than 25 percent by weight.

24. The method according to claim 23, wherein the glossy varnish has a resin content of more than 30 percent by weight.

25. The method according to claim 6, wherein the glossy varnish contains a styrene acrylate copolymer.

26. The method according to claim 1, which further comprises metering the glossy varnish in the varnishing unit with a screen roller having a take-up volume of about 13 $cm^3/m^2$ of varnished printing material surface.

27. The method according to claim 1, which further comprises applying at least one of warm air or thermal radiation at least to a printed and varnished side of the printing material after the step of coating the printing material with the glossy varnish.

28. The method according to claim 1, wherein the surface energy of the at least one admixed material is less than $40*10^{-3}$ N/m.

29. The method according to claim 28, wherein the surface energy of the at least one admixed material is less than $25*10^{-3}$ N/m.

30. The method according to claim 28, wherein the at least one admixed material is selected from the group consisting of silicone oil, PTFE (polytetrafluorethylene) and a derivative thereof.

31. The method according to claim 1, wherein the at least one material with a low surface energy admixed to the matte varnish has a percentage of less than 2 percent by weight.

32. A printed product, comprising:

a printing material having at least one side with a surface;

an oil-based printing ink printed on said surface;

an oil-based matte varnish coated on or a matte ink printed on a part of said printed surface, said matte varnish or matte ink containing matting means;

at least one material having a low surface energy being admixed to said matte varnish or said matte ink; and a water-based glossy varnish coated on said entire printed surface including said part of said surface coated with said matte varnish or printed with said matte ink; and the glossy varnish being prevented from thoroughly wetting the matte varnish or matte ink due to the admixed material with low surface energy, permitting the matte varnish or matte ink to maintain its appearance.

33. The printed product according to claim 32, wherein said part of said surface coated with said matte varnish or printed with said matte ink and coated with said glossy varnish has a value of glossiness of less than 25%.

34. The printed product according to claim 32, wherein said part of said surface coated with said matte varnish or printed with said matte ink and coated with said glossy varnish has a value of glossiness of less than 20%.

35. The printed product according to claim 32, wherein said printing ink being only coated with said glossy varnish has a value of glossiness of more than 60%.

36. The printed product according to claim 32, wherein said printing ink being only coated with said glossy varnish has a value of glossiness of more than 70%.

37. The printed product according to claim 32, wherein said printing ink being only coated with said glossy varnish has a value of glossiness of approximately 80%.

38. The printed product according to claim 32, wherein said matte varnish has a high content of said matting means.

39. The printed product according to claim 32, wherein said glossy varnish contains a softening agent.

40. The printed product according to claim 32, wherein said at least one material has a low surface energy of less than $40*10^{-3}$ N/m.

41. The printed product according to claim 40, wherein said surface energy is less than $25*10^{-3}$ N/m.

42. The printed product according to claim 32, wherein said at least one material with a low surface energy is selected from the group consisting of silicone oil, PTFE (polytetrafluorethylene) and a derivative thereof.

* * * * *